US005391065A

United States Patent [19]

Wolverton et al.

[11] Patent Number: 5,391,065

[45] Date of Patent: Feb. 21, 1995

[54] PARALLEL ADJUSTMENT ASSEMBLY FOR A SCROLL COMPRESSOR

[75] Inventors: Steven R. Wolverton; Terry L. Kietzman, both of Mooresville, N.C.

[73] Assignee: Ingersoll-Rand Company, Woodcliff Lake, N.J.

[21] Appl. No.: 143,413

[22] Filed: Oct. 26, 1993

[51] Int. Cl.[6] ..... F04C 18/04

[52] U.S. Cl. ..... 418/55.3; 418/55.5; 418/57

[58] Field of Search ..... 418/55.3, 55.5, 57

[56] References Cited

U.S. PATENT DOCUMENTS 4,300,875 11/1981 Fischer et al. ..... 418/57

FOREIGN PATENT DOCUMENTS 3729319 3/1989 Germany ..... 418/55.3

1-149468 6/1989 Japan .

*Primary Examiner*—John J. Vrablik

*Attorney, Agent, or Firm*—Victor M. Genco, Jr.

[57] ABSTRACT

A parallel adjustment assembly is provided for a scroll compressor which includes an orbiting scroll and a fixed scroll. The parallel adjustment assembly includes a housing and an eccentric guide shaft having opposed first and second ends. A step is defined by the eccentric guide shaft at an intermediate position along the shaft. A first bearing is fixedly mounted on the housing. The first bearing rotatably mounts the first end of the eccentric guide shaft. The eccentric guide shaft is moveable axially with respect to the first bearing. A biasing member biases the eccentric guide shaft in a direction toward the fixed scroll. A positioner, which is made integral with the eccentric guide shaft, precisely positions the eccentric guide shaft in the thrust direction.

5 Claims, 2 Drawing Sheets

PARALLEL ADJUSTMENT ASSEMBLY FOR A SCROLL COMPRESSOR

BACKGROUND OF THE INVENTION

This invention generally relates to scroll compressors, and more particularly to an adjustment assembly for providing parallelism between an orbiting scroll and a fixed scroll of a scroll compressor.

In a clearance type scroll compressor, the involute profiles of the fixed and orbiting scrolls are designed to operate within close proximity to, but in non-contacting relation with, each other. A larger than required clearance between the two scrolls will result in compressed air leakage, increased compressor power consumption, reduced capacity, and an overall reduction in the life of compressor bearings.

A parameter which determines the required clearance between the two involute profiles to prevent scroll contact is the parallelism between these two profiles. In this regard, a conventional configuration of a clearance scroll compressor requires extremely high precision machining of the compressor housing, the fixed scroll, and the orbiting scroll to obtain the required parallelism. However, such precision in the manufacture of these scroll compressor sub-assemblies significantly increases manufacturing costs.

The foregoing illustrates manufacturing and operational requirements relating to clearance type scroll compressors. It would be advantageous to provide an apparatus which effectively, efficiently, and economically provides a means for achieving parallelism between the two scrolls of a scroll compressor, thereby significantly reducing the manufacturing costs attendant with the machining of the scroll compressor housings, fixed scrolls, and orbiting scrolls. Accordingly, a suitable alternative is provided including features more fully disclosed hereinafter.

SUMMARY OF THE INVENTION

In one aspect of the present invention, this is accomplished by providing an adjustment assembly for a scroll compressor for achieving parallelism between an orbiting scroll and a fixed scroll. The adjustment assembly includes an eccentric guide shaft having opposed first and second ends. The second end of the eccentric guide shaft is integrally connected with the orbiting scroll. A first bearing, having an inner and an outer race, rotatably mounts the first end of the eccentric guide shaft within a scroll compressor housing. The eccentric guide shaft is moveable axially relative to the inner race of the first bearing along a predetermined path of travel. A biasing member biases the eccentric guide shaft along the path of travel in a direction toward the fixed scroll. Additionally, a positioner which is made integral with the eccentric guide shaft, precisely positions the eccentric guide shaft in a predetermined location along the path of travel.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
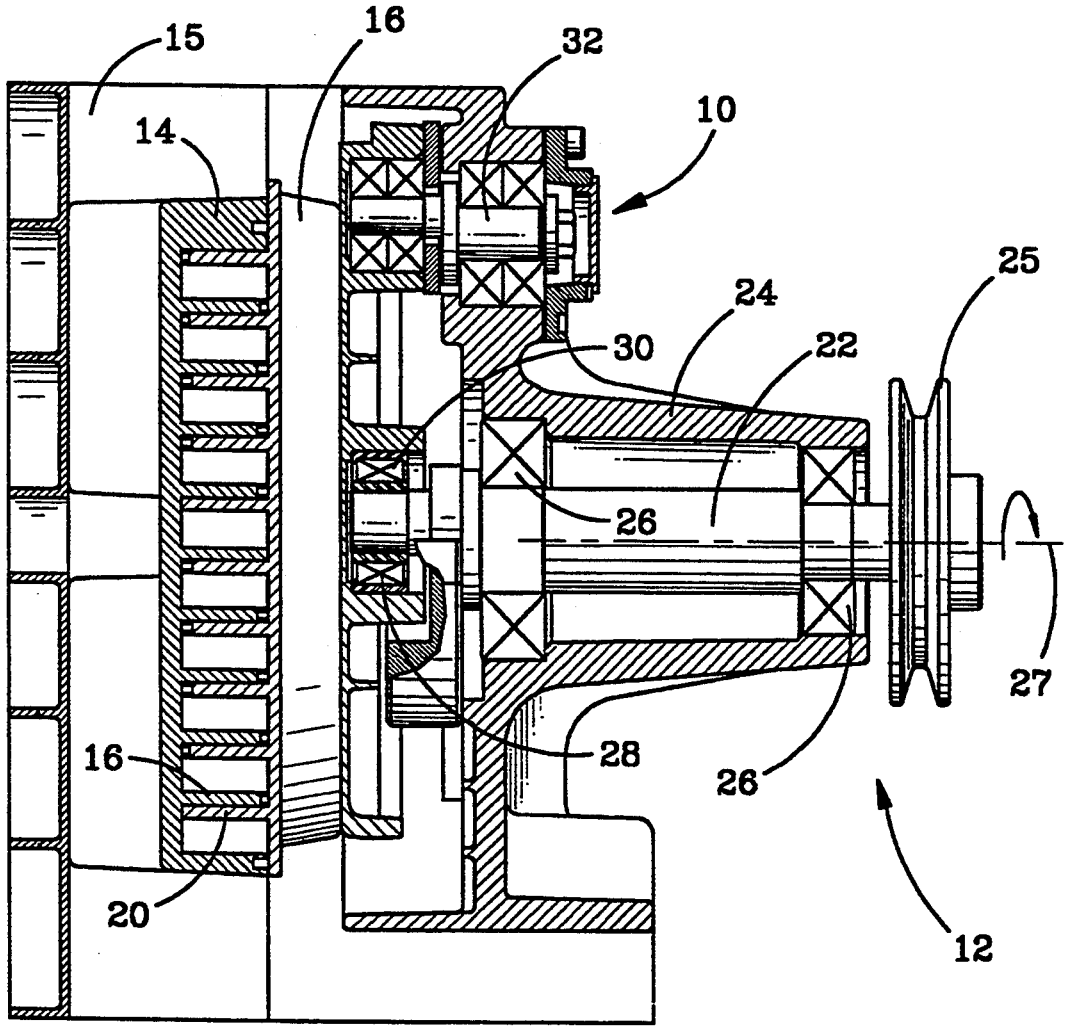
FIG. 1 is a partial sectional view of a scroll compressor illustrating the apparatus of the present invention.

Referring now to the drawings, wherein similar reference characters designate corresponding parts throughout the several views, FIG. 1 generally illustrates at 10 the apparatus of the present invention mounted for operation in a clearance type scroll compressor 12. It should be understood that although the apparatus 10 is described herein for use with a clearance type scroll compressor, the apparatus 10 may also be employed with a contact type scroll compressor, vacuum pumps, or other displacement machines operating according to the spiral principle.

Scroll compressor 12 includes a first fixed displacement element or fixed scroll 14 mounted on a first scroll compressor housing 15. The fixed scroll 14 has formed thereon a first wrap or involute 16. A second movable displacement element or orbiting scroll 18 is mounted to perform a translatory circular movement, i.e. the entirety of the orbiting scroll 18 moves around a predetermined circular path but does not rotate about an axis. The orbiting scroll 18 has formed thereon a second involute 20 which is suitably dimensioned to interengage with the first involute 16. The first involute 16 and the second involute 20 interengage to form spiral regions of limited extent which move radially outwardly or radially inwardly when the orbiting scroll 18 is displaced over its circular path relative to the fixed scroll 14, which thereby produces the conveying or fluid displacing effect of the scroll compressor 12.

An eccentric drive shaft 22 is mounted for operation in a second scroll compressor housing 24, and the eccentric drive shaft 22 is supported by bearings 26. During operation, a conventional prime mover, such as an electric motor, (not shown) is engageable with a pulley 25, or other suitable engagement member such as a gear (not shown), to cause the eccentric drive shaft 22 to rotate about an axis 27. The eccentric drive shaft 22 is provided with a driven end having a shaft stem 28 which is mounted in a bearing 30. The shaft stem 28 is operably connected with the orbiting scroll 18 to drive the orbiting scroll around the predetermined circular path.

Figure 3:
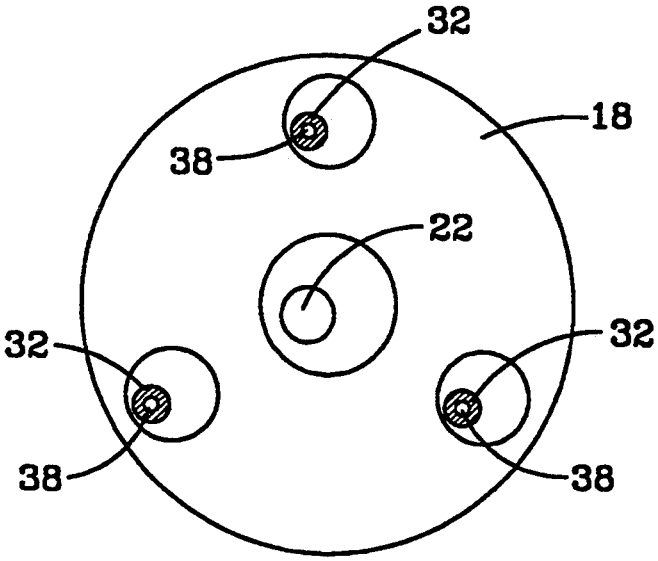
FIG. 3 is a diagram illustrating a predetermined number of, and a predetermined placement of, the apparatus of the present invention on an orbiting scroll of the scroll compressor.

As is known in the art, in scroll compressors or scroll fluid machines of the type illustrated in FIG. 1, to ensure that the orbiting scroll 18 moves along the predetermined circular path with respect to the fixed scroll 14, without autorotation, a passive eccentric guide shaft 32 is employed to execute eccentric rotations corresponding to the eccentricity of the eccentric drive shaft 22. Therefore, the eccentric guide shaft 32 executes passive eccentric rotations following the driving rotation of the eccentric drive shaft 22. In this way, while the autorotation of the orbiting scroll 18 can be inhibited, its controlled movement along the circular path can be carried out. In typical scroll fluid machines, three eccentric guide shafts 32 are arranged symmetrically about the eccentric drive shaft 22 at about 120° apart as best illustrated in FIG. 3.

Figure 2:
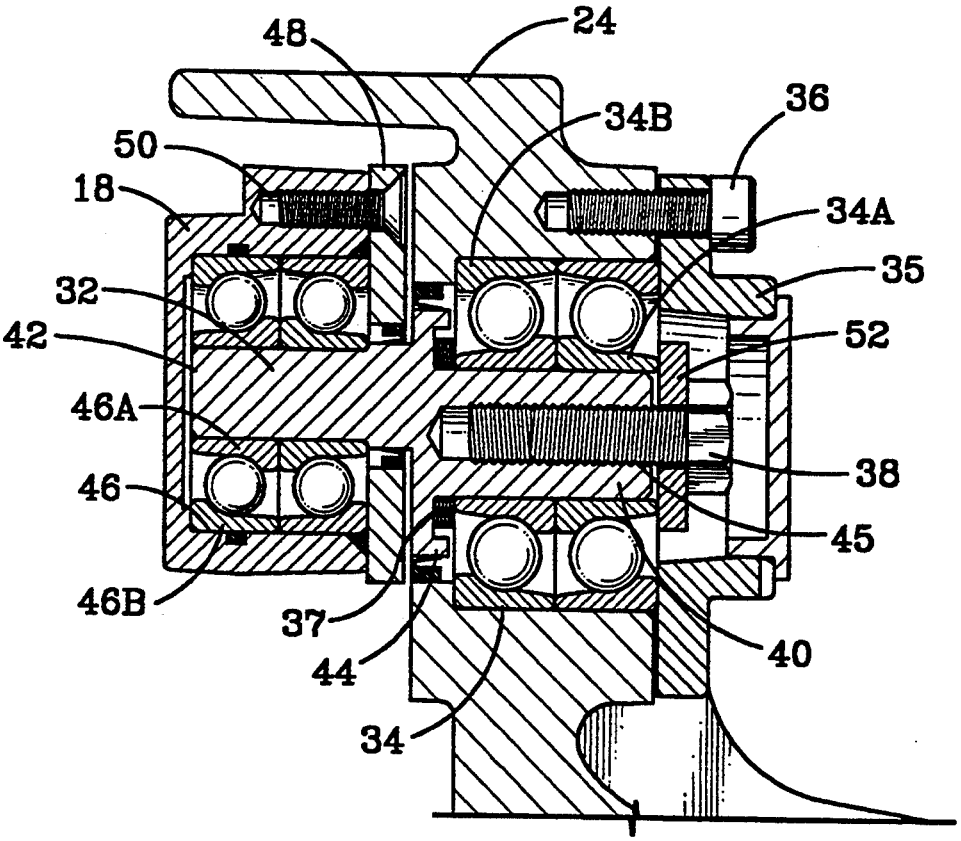
FIG. 2 is an enlarged view of the apparatus of the present invention which is illustrated in FIG. 1.

FIG. 2 illustrates an enlarged view of the apparatus 10 of the present invention which is illustrated in FIG. 1. The apparatus 10 permits a fixed scroll 14 and a orbiting scroll 18 to be adjusted to achieve parallelism relative to each other. The apparatus 10 includes the eccentric guide shaft 32, a first bearing 34, a biasing member 37, and a positioner 38.

The eccentric guide shaft 32 includes opposed first and second ends, 40 and 42, respectively. The second end 42 is integrally connected with the orbiting scroll 18. Formed on the eccentric guide shaft 32, in a location intermediate the first and second shaft ends, 40 and 42, respectively, is a step 44. Formed in the first end 40 of the eccentric guide shaft 32 is a threaded aperture 45 which will be described in further detail hereinafter.

The first bearing 34, having an inner race 34A and an outer race 34B, is fixedly mounted within housing 24. In the illustrated embodiment of the apparatus 10, a first bearing retainer 35 and a threaded fastener 36 fixedly locate the first bearing 34 within the housing 24. The first bearing 34 rotatably mounts the first end 40 of the eccentric guide shaft 32 in such a manner to permit back and forth movement of the eccentric guide shaft, with respect to the inner race 34A, along a predetermined path of travel. As used herein, the predetermined path of travel is parallel to the axis 27. A second bearing 46, having an inner race 46A and an outer race 46B is fixedly mounted on the orbiting scroll 18. In the illustrated embodiment of the apparatus 10, a second bearing retainer 48 and a threaded fastener 50 fixedly locate the second bearing within the orbiting scroll 18. The second bearing 46 rotatably mounts the second end 42 of the eccentric guide shaft 32 in such a manner to integrally connect the eccentric guide shaft with the orbiting scroll. For example, and in the illustrated embodiment, the second end 42 of the eccentric guide shaft 32 is "press fit" into the inner race 46A.

The biasing member 37 biases the eccentric guide shaft 32 in a direction toward the fixed scroll. In the illustrated embodiment of the apparatus 10, the biasing member 37 comprises a predetermined number of Belleville washers which are positioned about the eccentric guide shaft 32 in a location between the step 44 and the first bearing 34. During operation of the scroll compressor 12, a pressure is generated between the fixed scroll 14 and the orbiting scroll 18. This pressure places a load upon the orbiting scroll 18 in a direction away from the fixed scroll 14. The predetermined number of Belleville washers should generate a total biasing force against the eccentric guide shaft 32 greater than the load which is generated by the pressure between the fixed and orbiting scrolls.

The positioner 38 is made integral with the guide shaft 32. More particularly and in the preferred embodiment, the positioner 38 is a threaded assembly which is screwthreadably received by the threaded aperture 45. A retaining washer 52 is disposed between the threaded assembly and the first bearing 34.

As stated hereinabove, a parameter which determines the required clearance between the two scrolls of a clearance type scroll fluid machine, such as the clearance scroll compressor 12, is the parallelism between the first and second involutes, 16 and 20, respectively. The conventional configuration of a clearance scroll compressor requires extremely high precision machining of the compressor housing, the fixed scroll, and the orbiting scroll to obtain the required parallelism, but this precision in the manufacture of these scroll compressor sub-assemblies significantly increases manufacturing costs. The present invention provides an economical and effective apparatus for achieving the requisite parallelism between the fixed scroll 14 and the orbiting scroll 18.

In operation, the apparatus 10 reduces the precision required in the manufacture of a clearance type scroll compressor by permitting the orbiting scroll 18 to be aligned with, or to be made parallel with, the fixed scroll 14. This adjustment toward parallelism between the fixed and orbiting scroll is accomplished by precisely positioning any one of, or all of, the eccentric guide shafts 32 with respect to an inner race 34A of a first bearing 34. This adjustment is obtained by placing a suitable biasing member 37 between the first bearing and the step 44. The biasing member 37 is then compressed in its nominal design location to provide a load greater than the maximum bearing thrust load generated by the pressure between the fixed scroll 14 and the orbiting scroll 18. The positioner 38 is turned, either in a clockwise or counterclockwise rotation, which thereby positions the first end 40 of the eccentric guide shaft 32 in a predetermined location along the path of travel relative to the inner race 34A. Consequently, the positioning of the eccentric guide shaft 32 relative to the inner race 34A positions the orbiting scroll 18 in a predetermined location with respect to the fixed scroll 14. The adjustment provided by the apparatus 10 permits the positioning of the orbiting scroll 18 in three distinct planes, X, Y, and Z, respectively. Adjustments to the orbiting scroll in the X plane provide for lateral positioning of the orbiting scroll 18 with respect to the axis 27. Adjustments to the orbiting scroll in the Y plane provide for longitudinal positioning of the orbiting scroll 18 with respect to the axis 27. Adjustments to the orbiting scroll in the Z plane provide for positioning of the orbiting scroll 18 along the predetermined path of travel which is parallel to the axis 27.

While this invention has been illustrated and described in accordance with a preferred embodiment, it is recognized that variations and changes may be made therein without departing from the invention as set forth in the following claims.

Having described the invention, what is claimed is:

1. In a scroll compressor having a housing, a fixed scroll member fixedly attached to the housing, and an orbiting scroll member which is mounted on an eccentric drive shaft which drives the orbiting scroll member through a predetermined circular path in interengaging relation with the fixed scroll, a pressure being generated between the fixed and orbiting scroll members during scroll compressor operation which loads the orbiting scroll member with a predetermined force and which drives the orbiting scroll member in a direction away from the fixed scroll member, an adjustment assembly for achieving parallelism between the orbiting scroll member and the fixed scroll member, the adjustment assembly comprising:

an eccentric guide shaft having opposed first and second ends, and a step located at an intermediate position along the shaft, and wherein the second end is connected to the orbiting scroll member;

a bearing, mounted by the housing and having an inner and an outer race, rotatably mounting the first end of the eccentric guide shaft, the first end of the eccentric guide shaft ending moveable axially, along a predetermined path of travel, relative to the inner race;

means for biasing the eccentric guide shaft along the predetermined path of travel in a direction away from the bearing, the biasing means comprising a predetermine number of Belleville washers which are positioned between the step and the bearing, and which generate a total biasing force which is greater than the load upon the orbiting scroll member; and means for selectably positioning the eccentric guide shaft in a predetermined location along the path of travel.

2. An adjustment assembly, as claimed in claim 1, and wherein the eccentric guide shaft includes a threaded aperture, and wherein the means for positioning the eccentric guide shaft comprises a threaded assembly which is screwthreadably received by the threaded aperture of the eccentric guide shaft.

3. In a scroll compressor having a stationary housing, a fixed scroll member fixedly mounted to the housing, an orbiting scroll member, and a crank drive connected to drive the orbiting scroll member to produce a relative translatory circular movement between the fixed and orbiting scroll members, a parallel adjustment assembly comprising:

an eccentric guide shaft having opposed first and second ends, and wherein a step is defined by the eccentric guide shaft at an intermediate position along the shaft;

a first bearing fixedly mounted on the housing, the first bearing having an inner and an outer race and rotatably mounting the first end of the eccentric guide shaft, the first end of the guide shaft being moveable axially, along a predetermined path of travel, relative to the inner race;

a second bearing fixedly mounted on the orbiting scroll member, the second bearing rotatably mounting the second end of the eccentric guide shaft integrally with the orbiting scroll member;

means for biasing the eccentric guide shaft along the predetermined path of travel in a direction away from the first bearing; and selectable positioning means made integral with the eccentric guide shaft for selectably positioning the eccentric guide shaft in a predetermined location along the path of travel.

4. A parallel adjustment assembly, as claimed in claim 3, and wherein the biasing means is a predetermined number of Belleville washers which generate a total biasing force which is greater than a thrust load generated by pressure between the fixed and orbiting scrolls.

5. An adjustment assembly, as claimed in claim 3, and wherein the eccentric guide shaft includes a threaded aperture, and wherein the selectably positioning means is a threaded assembly which is screwthreadably received by the threaded aperture of the eccentric guide shaft.

* * * * *